US007641511B2

(12) United States Patent
DeMonica et al.

(10) Patent No.: US 7,641,511 B2
(45) Date of Patent: Jan. 5, 2010

(54) JACK CABLE ASSEMBLY WITH SUPPORT TRAY AND METHOD OF MAKING SAME

(75) Inventors: Michael J. DeMonica, Cortland, OH (US); Michael E. Francis, Beaver Falls, PA (US); John A. Yurtin, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/998,934

(22) Filed: Dec. 3, 2007

(65) Prior Publication Data

US 2009/0142957 A1 Jun. 4, 2009

(51) Int. Cl.
*H01R 13/60* (2006.01)

(52) U.S. Cl. ..... 439/527

(58) Field of Classification Search ..... 439/527, 439/529, 533

See application file for complete search history.

(56) References Cited

U.S. PATENT DOCUMENTS 4,806,112 A * 2/1989 Roberts et al. ..... 439/144
5,649,838 A 7/1997 Sung
6,142,799 A 11/2000 Marcel
6,527,581 B1 * 3/2003 Wang ..... 439/445
6,894,219 B2 5/2005 Culbertson
6,935,903 B2 8/2005 Gaidosch

* cited by examiner

*Primary Examiner*—Edwin A. Leon
*Assistant Examiner*—Vanessa Girardi
(74) *Attorney, Agent, or Firm*—Thomas N. Twomey

(57) ABSTRACT

An electrical jack cable assembly includes a jack cable connector and an adaptor coupling for attaching the connector to a support. The adaptor coupling has a face plate and a tray that extends to a rear wall. The connector body is retained in the tray behind the abutment wall so that the rear wall resists any movement of the connector body with respect to the adaptor coupling in the plug-in direction. The jack cable assembly is made by providing a jack cable connector providing an adaptor coupling having a tray that extends rearwardly to a rear wall and assembling the connector body to the tray by slanting the connector body and inserting the slanted connector body into the tray until it passes over the rear wall of the tray. The rear end of the connector body is then pushed down for retaining the connector body firmly and positively in the tray.

9 Claims, 3 Drawing Sheets

JACK CABLE ASSEMBLY WITH SUPPORT TRAY AND METHOD OF MAKING SAME

BACKGROUND OF THE INVENTION

This invention relates generally to a jack cable assembly comprising an electrical jack cable connector and an adaptor coupling for mounting the electrical jack cable connector on a support for receiving an electrical plug-in connector and to a method for making the jack cable assembly.

It is already known to provide a jack cable assembly comprising an electrical jack cable connector and an adaptor coupling for mounting the electrical jack cable connector on a support for receiving an electrical plug-in connector. In the known assembly, an annular adaptor is pushed into a smaller hole in a support panel from one side, usually the outside of the support panel and retained by flexible lock arms engaging an opposite side, usually the inside of the support panel adjacent the hole. The electrical jack cable connector is then plugged into the adaptor from the opposite or inside of the support panel and retained by flexible lock arms of the electrical jack cable connector that engage the adaptor. Thus, the electrical jack cable connector is mounted on the support panel for receiving an electrical plug-in connector that is plugged into the electrical jack cable connector from the one side or outside of the panel through the smaller hole in the support panel.

A potential problem exists when the electrical cable jack connector is retained in the plug-in direction of the electrical plug-in connector by flexible lock arms and the electrical plug-in connector is plugged into and pulled out of the electrical jack cable connector often. Repeated plugging and unplugging tends to weaken the flexible lock arms so that electrical cable jack connector can be pushed back away from the support in the plug-in direction when the electrical plug-in connector is plugged into the cable jack connector in the plug-in direction resulting in failure to make an electrical connection.

SUMMARY OF THE INVENTION

The jack cable assembly of the invention provides a cable jack assembly having an adaptor coupling that resists the plug-in forces in a positive manner so that an electrical connection is made between the jack cable connector and a plug-in connector even after repeated plugging and unplugging of the plug-in connector in the plug-in direction.

The adaptor coupling preferably includes a tray for holding a connector body of the jack cable assembly so that a rear wall of the tray resists movement of connector body in the plug-in direction.

The adaptor coupling preferably includes a face plate and a socket that extends rearwardly from an opening in the face plate for receiving an electrical plug-in connector in the plug-in direction.

In another aspect, the jack cable assembly of the invention is made by providing a jack cable connector having a connector body, providing an adaptor coupling and assembling the jack cable connector to the adaptor coupling so that the connector body is held against a rear wall of the adaptor connector to resist movement of the connector body in the plug-in direction.

The adaptor coupling preferably includes a tray that is shaped to receive the connector body snugly.

The tray of the adaptor coupling may have a reduced height to facilitate assembly of the connector body into the tray.

DETAILED DESCRIPTION OF THE PREFERRED EMBODIMENTS

Figure 2:
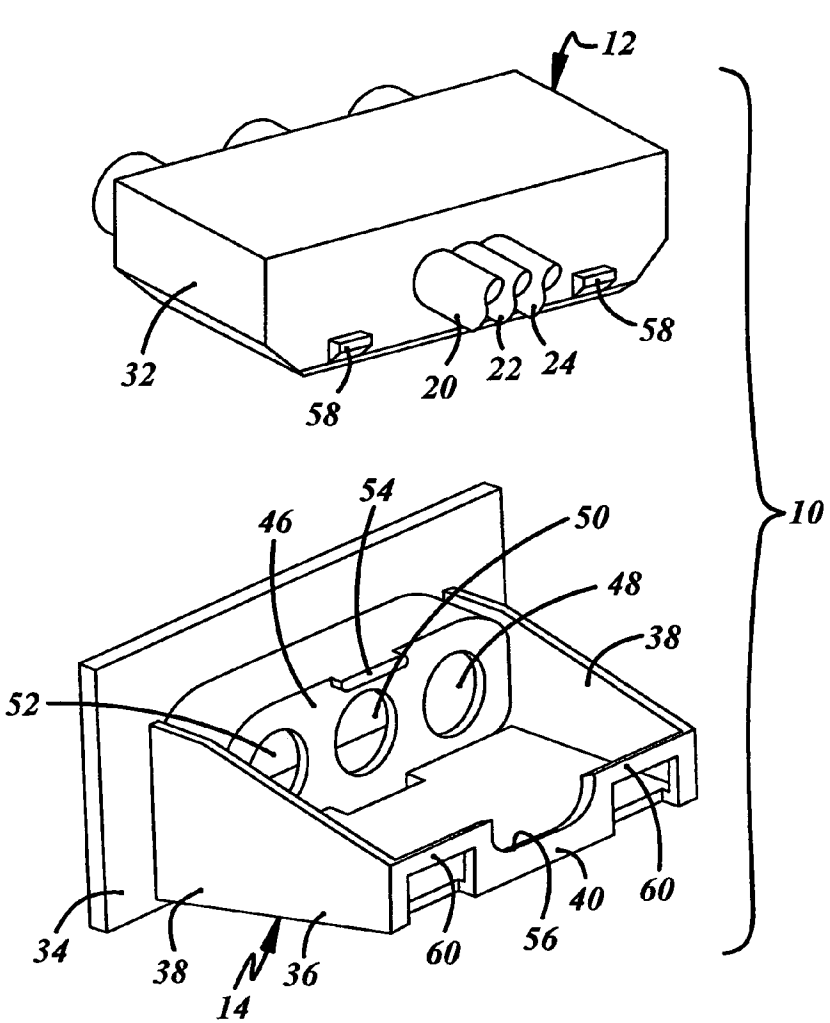
FIG. 2 is another exploded perspective view of the electrical jack cable assembly of FIG. 1.

Referring now to the drawings, the electrical jack cable assembly 10 comprises a jack cable connector 12 and an adaptor coupling 14 for attaching the connector 12 to a support (not shown). The adaptor coupling 14 can be attached to the support in any suitable manner, such by pushing the adaptor coupling 14 into a smaller hole of a support panel from one side and retaining the adaptor coupling 14 by flexible arms engaging the opposite side of the support panel as in the case of the prior art assembly discussed above. Alternatively, the adaptor coupling 14 may form an integral part of the support itself, such as being an integral part of a molded plastic panel in an automobile. In either event, the adaptor coupling 14 is preferably of one-piece construction that may result from molding the adaptor coupling in one piece.

Figure 6:
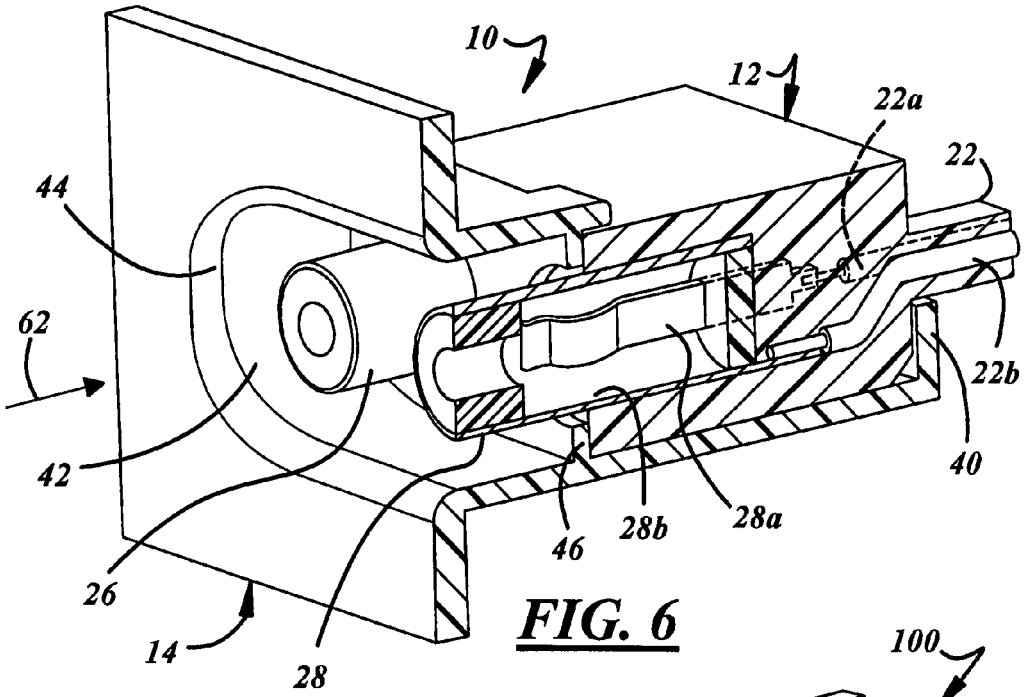
FIG. 6 is a longitudinal section of the electrical jack cable assembly of FIGS. 1 and 2.

Jack cable jack connector 12 comprises a plurality of electric cables 20, 22 and 24 and a plurality of grounded electric terminals 26, 28 and 30 that are attached to the ends of the electric cables 20, 22 and 24 respectively. Each of the electric cables comprises a signal cable and a ground cable that are attached to an inner signal contact and an outer ground shell respectively. More particularly as shown in FIG. 6, the typical electric cable 22 comprises a signal cable 22*a* that is attached to an inner signal contact 28*a* and a ground cable 22*b* that is attached to the outer ground shell 28*b*. The typical signal cable 22*a* and ground cable 22*b* can be attached to the respective inner signal contact 28*a* and outer ground shell 28*b* in any suitable manner such as by soldering the cable cores to attachment tabs at the inner ends of the signal contact 28*a* and ground cable 28*b* as shown in FIG. 6.

Figure 1:
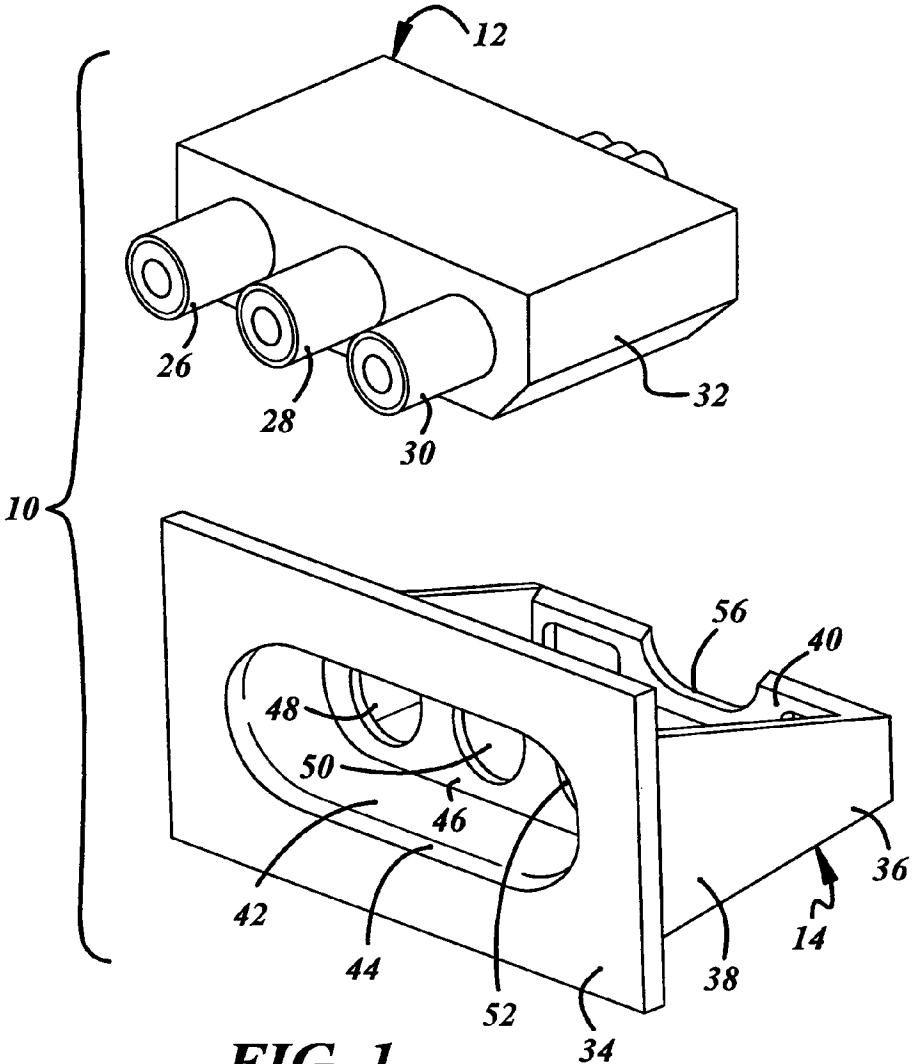
FIG. 1 is an exploded perspective view of an electrical jack cable assembly illustrating an embodiment of the invention.

The ends of the electric cables 20, 22 and 24, signal cables as well as ground cables, and the attached electric terminals 26, 28 and 30 are all spaced apart and insert molded in a molded connector body 32 of a suitable plastic electrically insulating material. When the molded connector body 32 is cured, three juxtaposed electric cables 20, 22 and 24 enter the rear end of the connector body 32 (FIG. 2) while the attached electric terminals 26, 28 and 30 protrude from the front end of the connector body 32 in a spaced apart relationship (FIG. 1).

Adaptor coupling 14 has a face plate 34 and a tray 36 that has side walls 38 and a rear wall 40 of reduced height. Adaptor coupling 14 preferably includes a socket 42 at the forward end that extends rearwardly from an opening 44 in the face plate 34 to an abutment wall 46 that is intermediate the face plate 34 and the rear wall 40. Abutment wall 46 has a plurality of through holes 48, 50 and 52 for receiving the respective electric terminals 26, 28 and 30 so as to protrude into the socket 42 from the portion of the tray 36 behind the abutment wall 46. Adaptor coupling 14 also preferably includes a hold-down tab 54 that projects rearwardly from abutment wall 46 and the rear wall 40 of reduced height preferably includes a central cable channel 56 for receiving the juxtaposed cables 20, 22 and 24 that project from the rear end of the molded connector body 32 as best shown in FIG. 5.

Figure 5:
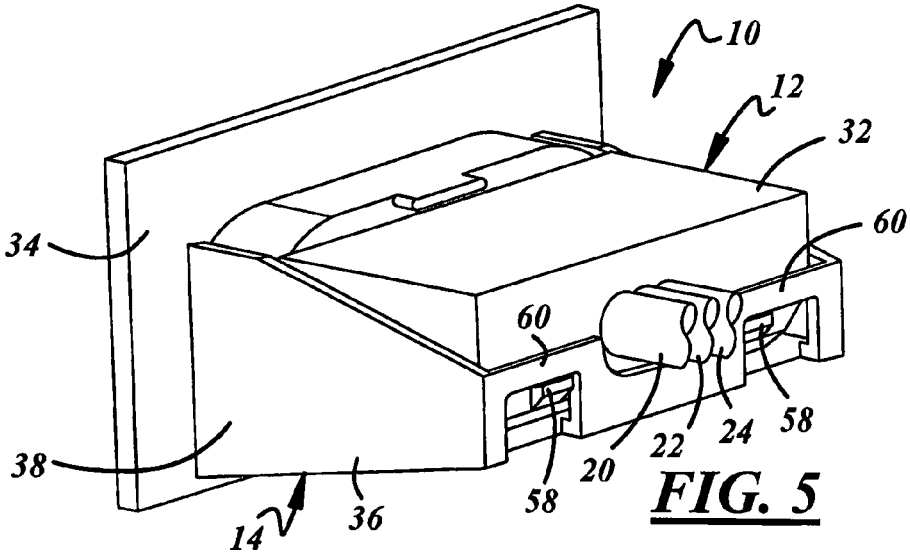

The molded connector body 32 is retained in the tray 36 behind the abutment wall 46 by lock projections 58 that snap into place beneath lock bars 60 that are formed by slots in the lower portions of the rear wall 40 which is also best shown in FIG. 5.

The jack cable assembly 10 is assembled in the following manner. The cable jack connector 12 is formed in a conventional and well known manner by attaching the female terminals 26, 28 and 30 to the ends of the respective cables 20, 22 and 24 and then insert molding the rearward portions of the female terminals 26, 28 and 30 in the molded connector body 32. The adaptor coupling 14 is also fabricated in any suitable manner such by a conventional injection molding technique. The cable jack connector 12 and adaptor coupling 14 are formed so that the connector body 32 fits snugly into the tray 36 between the abutment wall 46 and the rear wall 40 as shown in FIG. 5 so that the jack cable connector 12 is positively retained in the plug-in direction (shown by the arrow 62 in FIG. 6) by the rear wall 40 of the tray 36. In this regard it should be noted that the rear wall 40 preferably includes the channel 56 for cables 20, 22 and 24 to increase the height of the rear wall 40 on either side of the cables.

Figure 3:
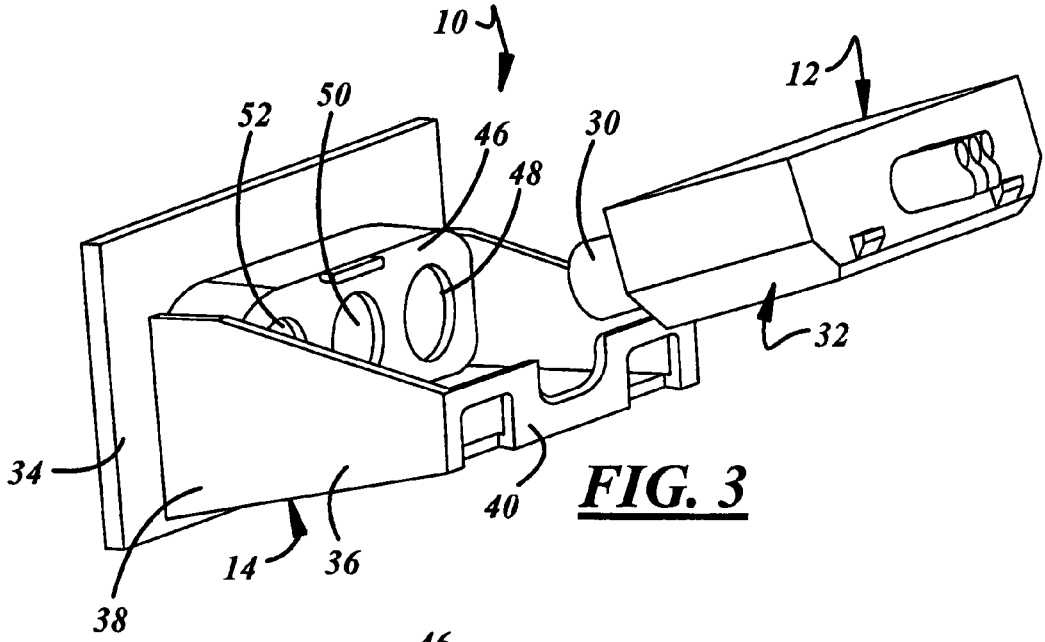
FIGS. 3, 4 and 5 are perspective views of the process of assembling the electrical jack cable assembly of FIGS. 1 and 2.

The jack cable connector 12 is assembled to the adaptor coupling 14 by slanting the connector body 32 at an angle of about 15 degrees with respect to the bottom of the tray 36 (or about 75 degrees with respect to the face plate 34) so that the connector body 32 can be inserted into the tray 36 behind the abutment wall 46 as best shown in FIG. 3.

Figure 4:
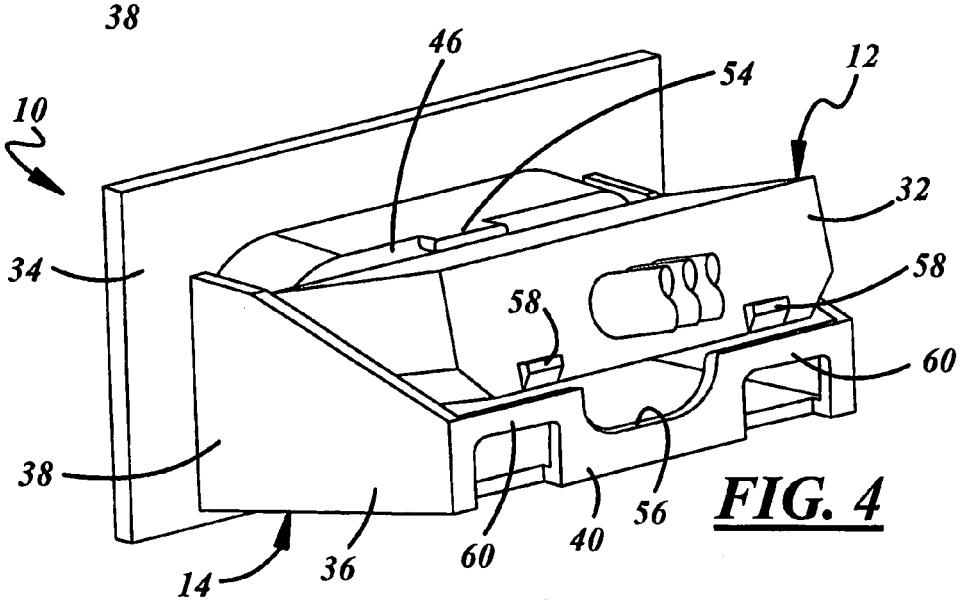

The projecting ends of the female terminals 26, 28 and 30 of the slanted connector body 32 are then aligned with the holes 48, 50 and 52 in the abutment wall 46 and inserted through the holes 48, 50 and 52 in the abutment wall 46 until connector body 32 engages the abutment wall 48 passes over the rear wall 40 of the tray 36 as shown in FIG. 4. The rear end of the connector body 32 is then pushed down against the floor of the tray 36 so that the lock projections 56 projecting from the rear end of the connector body 32 snap down under the lock bars 60 as shown in FIG. 5. The forward end of the connector body 32 is held down by the tab 54 and the jack cable connector 12 is held firmly and positively in the adaptor coupling 14 with the rear wall, 40 resisting any movement of the connector body 32 with respect to the adaptor coupling 14 in the plug-in direction indicated by the arrow 62 in FIG. 6.

A mating connector with male pins and an outer canister such as that shown in U.S. Pat. No. 5,649,838 granted Jul. 22, 1997 or the like (not shown) can be plugged into the cable jack 12 repeatedly without any danger of pushing the connector body 32 out of the adapter coupling 14 because the plug-in forces are transmitted to the rear wall 40 of the tray 36.

Figure 7:
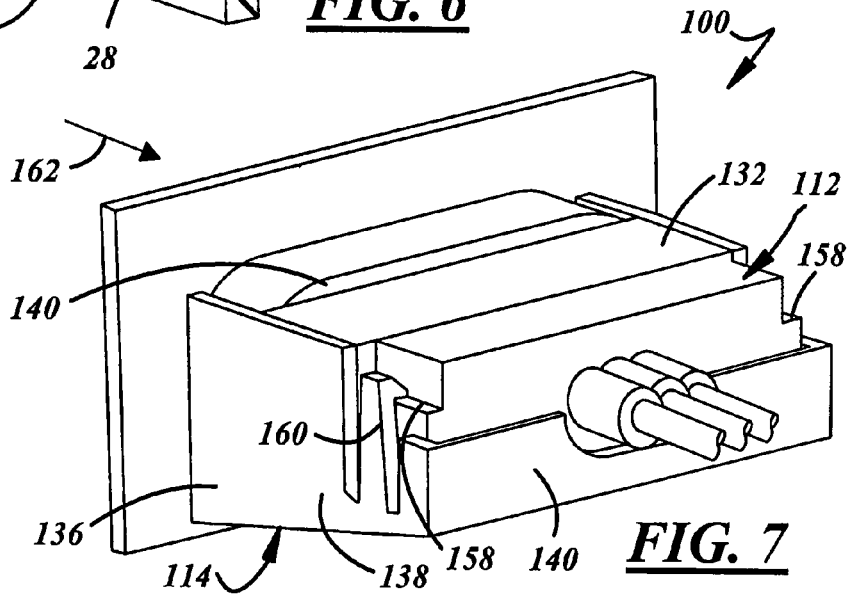
FIG. 7 is a rear perspective view of another electrical jack cable assembly illustrating a second embodiment of the invention.

FIG. 7 is a rear perspective view of another electrical jack cable assembly 100 illustrating a second embodiment of the invention. This embodiment has a modified connector body 132 for the jack cable connector 112 that includes a lock shoulder 158 at each side and a modified adaptor coupling 114 that has a flexible lock arm 160 in each side wall 138 of the tray 136. The jack cable connector 112 and adaptor coupling 114 are otherwise the same as the jack cable connector 12 and adaptor coupling 14 and assembled in the same manner. However, when the rear end of the connector body 132 is pushed down against the floor of the tray 136, the lock arms 160 now snap over the lock shoulders 158 on the rear end of the connector body 132 shown in FIG. 7 to hold the jack cable connector 112 firmly and positively in the adaptor coupling 114 with the rear wall 140 resisting any movement of the connector body 132 with respect to the adaptor coupling 114 in the plug-in direction indicated by the arrow 162, even though the forward end of the connector body is not held down by a tab as in the case of the earlier embodiment discussed above.

Figure 8:
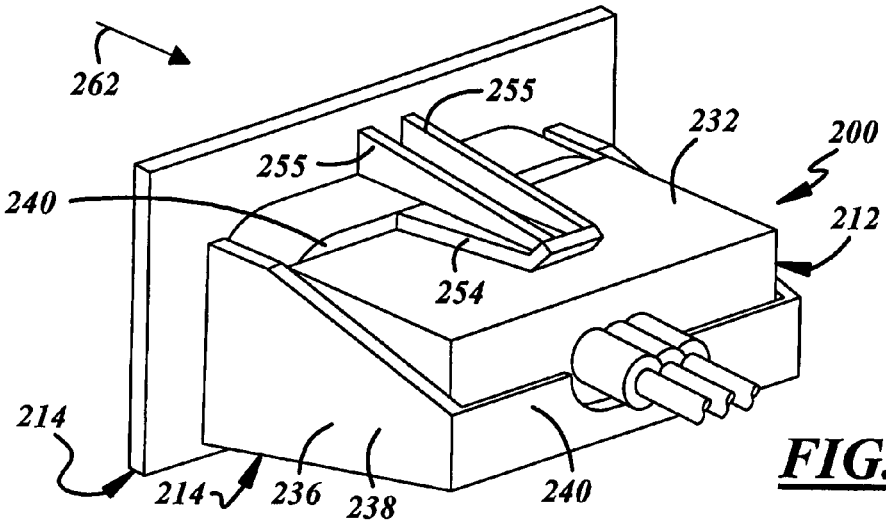
FIG. 8 is a rear perspective view of still another electrical jack cable assembly illustrating a third embodiment of the invention.

FIG. 8 is a rear perspective view of still another electrical jack cable assembly 200 illustrating a third embodiment of the invention. This embodiment also has a modified connector body 232 for the jack cable connector 212 that includes an elongate cantilevered tongue 254 (in place of the short tab 54) that is reinforced by gussets 255 and a modified adaptor coupling 214 that does not have any lock projections or shoulders. The jack cable connector 212 and adaptor coupling 214 are otherwise the same as the jack cable connector 12 and adaptor coupling 14 and assembled in a similar manner. However, when the connector body 232 is then pushed into the tray 236 behind the abutment wall 240, the end of the elongate cantilevered tongue 254 is raised and bowing the tongue 254 upwardly resiliently until the rear end of the connector body 232 passes over the rear wall 240 whereupon the tongue 254 recovers and pushes the rear end of the connector body down 232 against the floor of the tray 236 as shown in FIG. 8. The jack cable connector 212 is held firmly and positively in the adaptor coupling 214 with the rear wall 240 resisting any movement of the connector body 32 with respect to the adaptor coupling 214 in the plug-in direction indicated by the arrow 262.

In all of the embodiments discussed above, there is a positive two-way retention of the connector body 32, 132 or 232 in the respective tray 36, 136 or 236 with the rear wall 40, 140 or 240 resisting movement in the plug-in direction and the intermediate wall 46, 146 or 246 at the front of the tray resisting movement in the pull-out direction.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical jack cable assembly comprising a jack cable connector and an adaptor coupling for attaching the jack cable connector to a support of which the adaptor coupling may be an integral part, the jack cable connector having an electric cable and an electric terminal that is attached to an end of the electric cable, an end of the electric cable and the attached electric terminal being disposed in a connector body so that the electric cable enters a rear end of the connector body with the electrical terminal facing forward to be able to receive an electric plug-in connector when moved in a plug-in direction, the adaptor coupling having a tray that has side walls and a rear wall, means for retaining the connector body in the tray so that the rear wall resists any movement of the connector body with respect to the adaptor coupling in the plug-in direction, wherein the adaptor coupling has a face plate and a socket at a forward end that extends rearwardly from an opening in the face plate to an abutment wall that is intermediate the face plate and the rear wall of reduced height, and the abutment wall having a through hole for receiving the electric terminal so as to protrude into the socket from a portion of the tray behind the abutment wall.

2. The electrical jack assembly as defined in claim 1 wherein the means for retaining the connector body in the tray behind the abutment wall comprises a lock shoulder at each side of the connector body and a flexible lock arm in each side wall of the tray.

3. The electrical jack assembly as defined in claim 1 wherein the means for retaining the connector body in the tray behind the abutment wall comprises a hold-down tab that projects rearwardly from the abutment wall and projections of the connector body that snap into place beneath lock bars that are formed by slots in the lower portions of the rear wall of the adaptor coupling.

4. The electrical jack assembly as defined in claim 1 wherein the means for retaining the connector body in the tray behind the abutment wall comprises an elongate cantilevered tongue of the adaptor coupling that is reinforced by gussets, the elongate cantilevered tongue pushing the rear end of the connector body down against the floor of the tray to hold the jack cable connector firmly and positively in the adaptor coupling with the rear wall resisting any movement of the connector body with respect to the adaptor coupling in the plug-in direction.

5. An electrical jack cable assembly comprising a jack cable connector and an adaptor coupling for attaching the jack cable connector to a support of which the adaptor coupling may be an integral part, the jack cable connector having a plurality of electric cables and a plurality of grounded electric terminals that are attached to the ends of the electric cables respectively, each one of the plurality of electric cables comprising a signal cable and a ground cable that are attached to an inner signal contact and an outer ground shell of one of the plurality of grounded electric terminals respectively, the plurality of electric cables, signal cables as well as ground cables, and the attached plurality of grounded electric terminals attached thereto being insert molded in a molded connector body of a suitable plastic electrically insulating material so that the plurality of electric cables enter a rear end of the connector body while the attached plurality of electric terminals protrude from a front end of the connector body in a spaced apart relationship to be able to receive respective electric plug-in connectors when moved in a plug-in direction, the adaptor coupling having a face plate and a tray that has side walls and a rear wall of reduced height, the adaptor coupling further including a socket at a forward end that extends rearwardly from an opening in the face plate to an abutment wall that is intermediate the face plate and the rear wall of reduced height, the abutment wall having a plurality of through holes for receiving the plurality of electric terminals respectively so as to protrude into the socket from a portion of the tray behind the abutment wall, the rear wall of reduced height including a central cable channel for receiving the plurality of cables that project from the rear end of the molded connector body, and means for retaining the molded connector body in the tray behind the abutment wall so that the rear wall resists any movement of the connector body with respect to the adaptor coupling in the plug-in direction.

6. The electrical jack assembly as defined in claim 5 wherein the means for retaining the molded connector body in the tray comprises a hold-down tab that projects rearwardly from the abutment wall and projections of the connector body that snap into place beneath lock bars that are formed by slots in the lower portions of the rear wall of the adaptor coupling.

7. The electrical jack assembly as defined in claim 5 wherein the means for retaining the molded connector body in the tray comprises a lock shoulder at each side of the connector body and a flexible lock arm in each side wall of the tray.

8. The electrical jack assembly as defined in claim 5 wherein the means for retaining the molded connector body in the tray comprises an elongate cantilevered tongue of the adaptor coupling that is reinforced by gussets, the elongate cantilevered tongue pushing the rear end of the connector body down against the floor of the tray to hold the jack cable connector firmly and positively in the adaptor coupling with the rear wall resisting any movement of the connector body with respect to the adaptor coupling in the plug-in direction.

9. A method of making a jack cable assembly comprising the steps of:

providing a jack cable connector having an electric terminal attached to an end of a cable with a rearward portion of the electric terminal disposed in a connector body so that the cable enters a rearward end of the connector body with the electric terminal facing forward to be able to receive an electric plug-in connector when moved in a plug-in direction, providing an adaptor coupling having a tray that extends rearwardly to a rear wall, the tray being shaped so that the connector body fits snugly in the tray against the rear wall, assembling the connector body to the adaptor coupling so that the connector body is retained in the tray against the rear wall of the tray to resist any movement of the connector body with respect to the adaptor coupling in the plug-in direction, and wherein the electric terminal has a protruding end, the adaptor coupling has a face plate and an abutment wall between the face plate and the rear wall, the abutment wall has a hole extending therethrough, and the tray is shaped so that the connector body fits snugly in the tray between the abutment wall and the rear wall, and the adaptor coupling has a socket that extends rearwardly from an opening in the face plate to the abutment wall, and wherein the protruding end of the electric terminal is inserted through the hole of the abutment wall into the socket when the slanted connector body is inserted into the tray.

* * * * *